US011976390B2

(12) United States Patent
Jhunjhunwala

(10) Patent No.: US 11,976,390 B2
(45) Date of Patent: May 7, 2024

(54) WOVEN TEXTILE FABRIC

(71) Applicant: Sachin Jhunjhunwala, Mumbai (IN)

(72) Inventor: Sachin Jhunjhunwala, Mumbai (IN)

( * ) Notice: Subject to any disclaimer, the term of this patent is extended or adjusted under 35 U.S.C. 154(b) by 60 days.

(21) Appl. No.: 17/994,069

(22) Filed: Nov. 25, 2022

(65) Prior Publication Data

US 2024/0110317 A1 Apr. 4, 2024

(30) Foreign Application Priority Data

Sep. 29, 2022 (IN) ..... 202221055976

(51) Int. Cl.

| | |
|---|---|
| ***D03D 15/47*** | (2021.01) |
| ***D03D 13/00*** | (2006.01) |
| ***D03D 15/225*** | (2021.01) |
| ***D03D 15/283*** | (2021.01) |
| *D03D 1/00* | (2006.01) |

(52) U.S. Cl.

CPC ..... *D03D 15/47* (2021.01); *D03D 13/008* (2013.01); *D03D 15/225* (2021.01); *D03D 15/283* (2021.01); *D10B 2201/22* (2013.01); *D10B 2331/04* (2013.01)

(58) Field of Classification Search

CPC .... D03D 15/47; D03D 13/008; D03D 15/225; D03D 15/283; D10B 2201/22; D10B 2331/04

See application file for complete search history.

(56) References Cited

U.S. PATENT DOCUMENTS

| | | | | |
|---|---|---|---|---|
| 10,669,651 | B2 * | 6/2020 | Gupta | D03D 15/47 |
| 11,225,733 | B2 | 1/2022 | Agarwal | |
| 2020/0056309 | A1 * | 2/2020 | Gupta | D03D 15/283 |

FOREIGN PATENT DOCUMENTS

| | | | | | |
|---|---|---|---|---|---|
| CN | 105887283 | B | | 11/2017 | |
| CN | 107805868 | A | * | 3/2018 | |
| CN | 109183250 | A | * | 1/2019 | D03D 15/56 |
| CN | 109763242 | A | * | 5/2019 | |
| CN | 110541230 | A | * | 12/2019 | |
| CN | 110468484 | B | * | 11/2020 | D01D 5/092 |
| CN | 214354651 | U | | 10/2021 | |

* cited by examiner

*Primary Examiner* — Robert H Muromoto, Jr.

(74) *Attorney, Agent, or Firm* — The Roy Gross Law Firm, LLC; Roy Gross

(57) ABSTRACT

A woven textile fabric, the fabric including: a warp yarn with a yarn count of 10 s to 100 s including a blend of Lyocell fiber spun yarn and recycled polyester spun yarn; and a weft yarn with a yarn count of 10 s to 100 s including a blend of Lyocell fiber spun yarn and recycled polyester spun yarn, wherein the total content of the recycled polyester in the fabric is at least about 35%, further wherein said fabric exhibits rating of 3 or above when the fabric is tested for pilling after 1000 rubs. The advantageous fabric realized in accordance with embodiments of the present disclosure has excellent wrinkle resistance, high tensile strength, and low pilling.

7 Claims, No Drawings

WOVEN TEXTILE FABRIC

TECHNICAL FIELDS

The present disclosure pertains generally to the field of textile industry. In particular, the present disclosure provides a textile fabric that can find utility as home textile.

BACKGROUND

Background description includes information that may be useful in understanding the present invention. It is not an admission that any of the information provided herein is prior art or relevant to the presently claimed invention, or that any publication specifically or implicitly referenced is prior art.

Often in textile manufacturing, it becomes necessary to scrap products for one reason or another. For example, it could be that the products, once manufactured, did not meet the desired specifications, or perhaps, the product was not as marketable as anticipated. Further textiles used by the consumer are thrown into the landfills have become a big global problem. Apparel made from natural fibers takes years to decompose, whereas man-made fibers do not self-decompose. Woolen clothes do decompose but release methane and carbon dioxide into the atmosphere. This contributes towards global warming. Synthetic fabrics in the landfill release nitrous oxide which is a powerful greenhouse gas. Besides, toxic substances pollute groundwater and surrounding soil.

With increasing demand and problems associated with the decomposition of Apparel, recycling and reusing textiles, fibers, and waste materials is an effective way to build sustainability in the apparel industry. Numerous recycled textile fabrics are reported in the literature, and available in markets that are used by retailers and consumers. However, these recycled textile fabrics are of low quality, non-durable, and exhibit poor elasticity, chemical resistance, tensile strength, pilling, and the like.

There is, therefore, a need in the art to provide a new and improved textile fabric that is comfortable, breathable, exhibits high strength, low piling, and the likes that can find utility as a home textile. The present disclosure satisfies the existing needs, as well as others, and alleviates the shortcomings associated with conventional recycled fabrics.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability.

Objects

An object of the present disclosure is to provide a textile fabric that overcomes the deficiencies associated with the conventional woven textile fabric.

Another object of the present disclosure is to provide a textile fabric that exhibits high tensile strength and good piling resistance.

Another object of the present disclosure is to provide a textile fabric that is durable, wrinkle resistant, and comfortable to human skin.

Another object of the present disclosure is to provide a textile fabric that is economical and easy to manufacture.

SUMMARY

The present disclosure pertains generally to the field of textile industry. In particular, the present disclosure provides a textile fabric that can find utility as home textile.

An aspect of the present disclosure relates to a woven textile fabric, said fabric comprising: a warp yarn with a yarn count of 10 s to 100 s comprising a blend of Lyocell fiber spun yarn and recycled polyester spun yarn; and a weft yarn with a yarn count of 10 s to 100 s comprising a blend of Lyocell fiber spun yarn and recycled polyester spun yarn, wherein the total content of the recycled polyester in the fabric is at least about 35%, further wherein said fabric exhibits rating of 3 or above when the fabric is tested for pilling after 1000 rubs.

In some embodiments, the warp yarn comprises: Lyocell fiber spun yarn in an amount ranging from about 30 wt. % to about 65 wt. %; and recycled polyester spun yarn in an amount ranging from about 35 wt. % to about 70 wt. %. In some embodiments, the weft yarn comprises: Lyocell fiber spun yarn in an amount ranging from about 30 wt. % to about 65 wt. %; and recycled polyester spun yarn in an amount ranging from about 35 wt. % to about 70 wt. %.

In some embodiments, the warp yarn comprises Lyocell fiber spun yarn in an amount of about 65 wt. % and recycled polyester spun yarn in an amount of about 35 wt. %. In some embodiments, the weft yarn comprises Lyocell fiber spun yarn in an amount of about 65 wt. % and recycled polyester spun yarn in an amount of about 35 wt. %.

In some embodiments, the warp yarn comprises Lyocell fiber spun yarn in an amount of about 60 wt. % and recycled polyester spun yarn in an amount of about 40 wt. %. In some embodiments, the weft yarn comprises Lyocell fiber spun yarn in an amount of about 60 wt. % and recycled polyester spun yarn in an amount of about 40 wt. %.

In an embodiment, the warp yarn has density ranging from 60 to 195 ends per square inch (EPI). In some embodiments, the fabric comprises any of: a satin weave, a percale weave and a twill weave. The woven textile fabric of the present disclosure can be used as a bedding product, the bedding product being a bed sheet, a pillow case, a comforter, a coverlet, a pillow sham, a dust ruffle, a blanket, a bedspread, and a duvet cover.

Various objects, features, aspects and advantages of the inventive subject matter will become more apparent from the following detailed description of preferred embodiments, along with the accompanying drawing figures in which like numerals represent like components.

DETAILED DESCRIPTION

The following is a detailed description of embodiments of the disclosure depicted in the accompanying drawings. The embodiments are in such detail as to clearly communicate the disclosure. However, the amount of detail offered is not intended to limit the anticipated variations of embodiments; on the contrary, the intention is to cover all modifications, equivalents, and alternatives falling within scope of the present disclosure.

Each of the appended claims defines a separate invention, which for infringement purposes is recognized as including equivalents to the various elements or limitations specified in the claims. Depending on the context, all references below to the "invention" may in some cases refer to certain specific embodiments only. In other cases it will be recognized that references to the "invention" will refer to subject matter recited in one or more, but not necessarily all, of the claims.

Unless the context requires otherwise, throughout the specification which follows, the word "comprise" and variations thereof, such as, "comprises" and "comprising" are to be construed in an open, inclusive sense that is as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

The expression "rating of 3 or above" as used herein throughout the present disclosure, in the context of the fabric tested for pilling after 1000 rubs, generally denotes low pilling tendency of the fabric being tested. Specifically, when the pilling tendency of the finished fabric is measured by any of the standard methods ASTM D4970 or ISO 12945-2:2014 and rated on a scale/grade/rating of 1-5, the scale/rating/grade 1 indicates very severe pilling and scale/rating/grade 5 indicates no pilling after the specified number of rubs. The fabric of the present disclosure exhibits the rating of 3 or 4 or 5 after 1000 rubs or cycles, i.e. the woven textile fabric of the present disclosure has low pilling tendency.

The term "woven textile fabric", as used herein throughout the present disclosure, in the context of the fabric being tested for pilling tendency or pilling resistance denotes the dyed, bleached or printed fabric, or otherwise a fabric that is substantially ready for use (e.g. consumer use) without need to be subjected to any further processing that can alter its pilling tendency or pilling resistance. For example, the raw woven fabric may be subjected to dying and/or printing and/or bleaching process(es) to produce the ready to sale (or ready to use) fabric. Such fabric is subjected to the test for measurement of pilling resistance or pilling tendency.

In some embodiments, the numbers expressing quantities of ingredients, properties such as concentration, and so forth, used to describe and claim certain embodiments of the invention are to be understood as being modified in some instances by the term "about." Accordingly, in some embodiments, the numerical parameters set forth in the written description are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable.

The recitation of ranges of values herein is merely intended to serve as a shorthand method of referring individually to each separate value falling within the range. Unless otherwise indicated herein, each individual value is incorporated into the specification as if it were individually recited herein.

The headings and abstract of the invention provided herein are for convenience only and do not interpret the scope or meaning of the embodiments.

Various terms as used herein are shown below. To the extent a term used in a claim is not defined below, it should be given the broadest definition persons in the pertinent art have given that term as reflected in printed publications and issued patents at the time of filing.

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

The present disclosure pertains generally to the field of textile industry. In particular, the present disclosure provides a textile fabric that can find utility as home textile.

The present disclosure is on the premise that when a blend of Lyocell fiber spun yarn and recycled polyester spun yarn are used in warp and weft to prepare a textile fabric in the weight percentages as defined herein, the textile fabric exhibits excellent wrinkle resistance, high tensile strength, and low pilling. The observed properties are surprising.

An aspect of the present disclosure relates to a woven textile fabric, said fabric comprising: a warp yarn with a yarn count of 10 s to 100 s comprising a blend of Lyocell fiber spun yarn and recycled polyester spun yarn; and a weft yarn with a yarn count of 10 s to 100 s comprising a blend of Lyocell fiber spun yarn and recycled polyester spun yarn, wherein the total content of the recycled polyester in the fabric is at least about 35%, further wherein said fabric exhibits rating of 3 or above when the fabric is tested for pilling after 1000 rubs.

While any of the methods as known to or appreciated by a person skilled in the art for testing of pilling resistance can be used, preferred are ASTM D4970 and ISO 12945-2. In an embodiment, the fabric exhibits rating of 3 or above when the fabric is tested for pilling for 1000 rubs in accordance with ASTM D4970. In another embodiment, the fabric exhibits rating of 3 or above when the fabric is tested for pilling for 1000 rubs in accordance with ISO 12945-2:2014. ASTM D4970 and ISO 12945-2 methods make use of a Martindale Tester, wherein the fabric being tested is rubbed face to face for a specified number of rubs/cycles, and the pill balls are evaluated using a photographic visual standard for comparison and given a 1-5 rating, wherein rating/grade 1 indicates very severe pilling and rating/grade 5 indicates no pilling.

In some embodiments, the warp yarn and the weft yarns are spun yarns comprising a blend of Lyocell fiber and recycled polyester. Any conventional method for preparing a spun yarn, as known to the skilled artisans, may be used for realizing the spun yarns, having a blend of Lyocell fiber and recycled polyester for use in preparing woven fabrics of the present disclosure.

In some embodiments, warp yarn has yarn count of 10 s to 100 s, for example, 20 s to 30 s, 30 s to 40 s, 40 s to 60 s or 60 s to 80 s, preferably, warp yarn has yarn count of 20 s to 60 s. In some embodiments, weft yarn has yarn count of 10 s to 100 s, for example, 20 s to 30 s, 30 s to 40 s, 40 s to 60 s or 60 s to 80 s, preferably, weft yarn has yarn count of 20 s to 60 s.

In an embodiment, total content of the recycled polyester in the fabric is at least about 35%, for example, about 40% or about 50% or about 60% or about 70%, preferably, less than about 75%. In an embodiment, total content of the recycled polyester in the fabric ranges from 35% to 70%, for example, from about 35% to about 60%, preferably, from about 35% to about 55%, and most preferably, from about 35% to about 50%. In some embodiments, total content of the recycled polyester in the fabric ranges from about 35% to about 40%.

In some embodiments, the warp yarn comprises: Lyocell fiber spun yarn in an amount ranging from about 30 wt. % to about 65 wt. %; and recycled polyester spun yarn in an amount ranging from about 35 wt. % to about 70 wt. %.

In some embodiments, the warp yarn comprises: Lyocell fiber spun yarn in an amount ranging from about 35 wt. % to about 70 wt. %; and recycled polyester spun yarn in an amount ranging from about 30 wt. % to about 65 wt. %.

In some embodiments, the warp yarn comprises: Lyocell fiber spun yarn in an amount ranging from about 50 wt. % to about 65 wt. %; and recycled polyester spun yarn in an amount ranging from about 35 wt. % to about 50 wt. %.

In some embodiments, the warp yarn comprises: Lyocell fiber spun yarn in an amount ranging from about 60 wt. % to about 65 wt. %; and recycled polyester spun yarn in an amount ranging from about 35 wt. % to about 40 wt. %.

In some embodiments, the weft yarn comprises: Lyocell fiber spun yarn in an amount ranging from about 30 wt. % to about 65 wt. %; and recycled polyester spun yarn in an amount ranging from about 35 wt. % to about 70 wt. %.

In some embodiments, the weft yarn comprises: Lyocell fiber spun yarn in an amount ranging from about 35 wt. % to about 70 wt. %; and recycled polyester spun yarn in an amount ranging from about 30 wt. % to about 65 wt. %.

In some embodiments, the weft yarn comprises: Lyocell fiber spun yarn in an amount ranging from about 50 wt. % to about 65 wt. %; and recycled polyester spun yarn in an amount ranging from about 35 wt. % to about 50 wt. %.

In some embodiments, the weft yarn comprises: Lyocell fiber spun yarn in an amount ranging from about 60 wt. % to about 65 wt. %; and recycled polyester spun yarn in an amount ranging from about 35 wt. % to about 40 wt. %.

In some embodiments, the warp yarn comprises: Lyocell fiber spun yarn in an amount of about 65 wt. % and recycled polyester spun yarn in an amount of about 35 wt. %.

In some embodiments, the weft yarn comprises: Lyocell fiber spun yarn in an amount of about 65 wt. % and recycled polyester spun yarn in an amount of about 35 wt. %.

In some embodiments, the warp yarn comprises: Lyocell fiber spun yarn in an amount of about 60 wt. % and recycled polyester spun yarn in an amount of about 40 wt. %.

In some embodiments, the weft yarn comprises: Lyocell fiber spun yarn in an amount of about 60 wt. % and recycled polyester spun yarn in an amount of about 40 wt. %.

In some embodiments, the warp yarn has density ranging from 60 to 195 ends per square inch (EPI). In some embodiments, the warp yarn has density ranging from 60 to 150 ends per square inch. Yet in some embodiments, the warp yarn has density ranging from 60 to 100 ends per square inch.

In some embodiments, the weft yarn has density ranging from 40 to 405 picks per inch (PPI), for example, from 40 to 300, from 40 to 200 or from 40 to 150. In some embodiments, the weft yarn has density ranging from 40 to 100 picks per inch (PPI).

In some embodiments, the fabric has a thread count of 100 to 600 threads per square inch, for example, from 100 to 500 threads per square inch, or from 100 to 400 threads per square inch. In some embodiments, the fabric has a thread count of 100 to 400 threads per square inch In an embodiment, the fabric comprises any of: a satin weave, a percale weave and a twill weave. In an embodiment, the fabric comprises of a satin weave. In an embodiment, the fabric comprises of a percale weave. In a preferred embodiment, the fabric comprises of a twill weave.

In some embodiments, the woven textile fabric is used as a bedding product, the bedding product being selected from: a bed sheet, a pillow case, a comforter, a coverlet, a pillow sham, a dust ruffle, a blanket, a bedspread, and a duvet cover. The advantageous fabric realized in accordance with embodiments of the present disclosure can find utility as home textiles.

The woven twill textile fabric, realized in accordance with embodiments of the present disclosure can be made using any apparatus/loom known to a person skilled in the pertinent art. In an embodiment, fabric is prepared by using a pick insertion apparatus such as an air-jet or a Sulzer pick insertion apparatus. However, utilization of any other pick insertion apparatus, as known to or appreciated by a person skilled in the art to serve its intended purpose as laid down in the present disclosure, is completely within the scope of the present disclosure.

Table 1 herein-below provides different types of yarns along with their characteristics used for preparing fabrics.

TABLE 1

Characteristics of yarns

| Sr. No. | Yarn |
|---|---|
| Yarn 1 | Lyocell fiber spun yarn |
| Yarn 2 | Recycled Polyester spun yarn |
| Yarn 3 | Lyocell + Recycled Polyester spun yarn (20% + 80%) |
| Yarn 4 | Lyocell + Recycled Polyester spun yarn (30% + 70%) |
| Yarn 5 | Lyocell + Recycled Polyester spun yarn (40% + 60%) |
| Yarn 6 | Lyocell + Recycled Polyester spun yarn (60% + 40%) |
| Yarn 7 | Lyocell + Recycled Polyester spun yarn (65% + 35%) |
| Yarn 8 | Lyocell + Recycled Polyester spun yarn (70% + 30%) |

Table 2 below provides characteristics of different fabrics prepared by using different combinations of yarns, provided in Table 1, in the warp and weft.

TABLE 2

Characteristics of woven fabrics

| Sr. No. | Warp | Warp Count | Weft | Weft Count | Recycled Polyester content in fabric | Piling (1-5) | Tensile Strength (1-10) |
|---|---|---|---|---|---|---|---|
| 1. | Yarn 1 | 40s | Yarn 2 | 40s | 50 | 2 | 3 |
| 2. | Yarn 2 | 40s | Yarn 1 | 40s | 50 | 2 | 3 |

TABLE 2-continued

| Characteristics of woven fabrics | | | | | | | |
|---|---|---|---|---|---|---|---|
| Sr. No. | Warp | Warp Count | Weft | Weft Count | Recycled Polyester content in fabric | Piling (1-5) | Tensile Strength (1-10) |
| 3. | Yarn 3 | 60s | Yarn 3 | 60s | 80 | 3 | 3 |
| 4. | Yarn 4 | 60s | Yarn 4 | 60s | 70 | 3 | 4 |
| 5. | Yarn 5 | 60s | Yarn 5 | 60s | 60 | 3.5 | 5 |
| 6. | Yarn 6 | 60s | Yarn 6 | 60s | 40 | 4 | 8 |
| 7. | Yarn 7 | 60s | Yarn 7 | 60s | 35 | 4 | 8 |
| 8. | Yarn 8 | 60s | Yarn 8 | 60s | 30 | 4 | 7 |

It could be noted that the fabric realized in accordance with embodiments of the present disclosure i.e. fabric prepared by using spun yarns having a blend of Lyocell fiber and recycled polyester as warp and weft is advantageous, in that the resultant fabric is significantly economical. As can be seen from Table 2, fabric prepared by using spun yarns having Lyocell fibres in an amount ranging from 30 wt. % to 65 wt. % and recycled polyester in an amount ranging from 35 wt. % to 70 wt. % as warp and weft yarns exhibits marked improvement in properties such as pilling and tensile strength as compared to a fabric prepared using other spun yarn blends. More particularly, fabric prepared by using spun yarns having Lyocell fibres in an amount ranging from 50 wt. % to 65 wt. % and recycled polyester in an amount ranging from 35 wt. % to 50 wt. % as warp and weft yarns exhibits exceptionally good pilling and tensile strength.

The fabric of the present disclosure exhibits a low tendency of pilling, while achieving the balance between pilling resistance and the tensile strength. Further, the fabric of the present invention is significantly economical owing to usage of recycled cotton and recycled polyester.

While the foregoing describes various embodiments of the invention, other and further embodiments of the invention may be devised without departing from the basic scope thereof. The scope of the invention is determined by the claims that follow. The invention is not limited to the described embodiments, versions or examples, which are included to enable a person having ordinary skill in the art to make and use the invention when combined with information and knowledge available to the person having ordinary skill in the art.

Advantages

The present disclosure provides a textile fabric that overcomes the deficiencies associated with the conventional woven textile fabric.

The present disclosure provides a textile fabric that exhibits high tensile strength and piling resistance.

The present disclosure provides a textile fabric that is durable, wrinkle resistant, and comfortable to human skin.

The present disclosure provides a textile fabric that is economical and easy to manufacture.

I claim:

1. A woven textile fabric, said fabric comprising:

a warp yarn with a yarn count of 10 s to 100 s comprising a blend of Lyocell fiber spun yarn and recycled polyester spun yarn; and a weft yarn with a yarn count of 10 s to 100 s comprising a blend of Lyocell fiber spun yarn and recycled polyester spun yarn, wherein the total content of the recycled polyester in the fabric is at least about 35%, further wherein said fabric exhibits rating of 3 or above when the fabric is tested for pilling after 1000 rubs.

2. The fabric as claimed in claim 1, wherein the warp yarn comprises: Lyocell fiber spun yarn in an amount ranging from about 30 wt. % to about 65 wt. %; and recycled polyester spun yarn in an amount ranging from about 35 wt. % to about 70 wt. %.

3. The fabric as claimed in claim 1, wherein the weft yarn comprises: Lyocell fiber spun yarn in an amount ranging from about 30 wt. % to about 65 wt. %; and recycled polyester spun yarn in an amount ranging from about 35 wt. % to about 70 wt. %.

4. The fabric as claimed in claim 2, wherein the warp yarn and the weft yarn comprises Lyocell fiber spun yarn in an amount of about 65 wt. % and recycled polyester spun yarn in an amount of about 35 wt. %.

5. The fabric as claimed in claim 3, wherein the warp yarn and the weft yarn comprises Lyocell fiber spun yarn in an amount of about 60 wt. % and recycled polyester spun yarn in an amount of about 40 wt. %.

6. The fabric as claimed in claim 1, wherein the warp yarn has density ranging from 60 to 195 ends per square inch.

7. The fabric as claimed in claim 1, wherein the fabric comprises any of: a satin weave, a percale weave and a twill weave.

* * * * *